US010926536B2

(12) United States Patent
Higo et al.

(10) Patent No.: US 10,926,536 B2
(45) Date of Patent: Feb. 23, 2021

(54) PRINTING SYSTEM, PRINTING DEVICE, AND METHOD OF PRODUCING PRINTED OBJECT

(71) Applicant: SUNTORY HOLDINGS LIMITED, Osaka (JP)

(72) Inventors: Tatsutoshi Higo, Yamanashi (JP); Takuto Nakamura, Yamanashi (JP); Tomohiro Fujita, Yamanashi (JP)

(73) Assignee: SUNTORY HOLDINGS LIMITED, Osaka (JP)

( * ) Notice: Subject to any disclaimer, the term of this patent is extended or adjusted under 35 U.S.C. 154(b) by 0 days.

(21) Appl. No.: 16/640,164

(22) PCT Filed: Aug. 31, 2018

(86) PCT No.: PCT/JP2018/032307
§ 371 (c)(1),
(2) Date: Feb. 19, 2020

(87) PCT Pub. No.: WO2019/045034
PCT Pub. Date: Mar. 7, 2019

(65) Prior Publication Data

US 2020/0171821 A1 Jun. 4, 2020

(30) Foreign Application Priority Data

Aug. 31, 2017 (JP) ..... JP2017-167292

(51) Int. Cl.
*B41J 2/085* (2006.01)
*B41J 2/09* (2006.01)

(52) U.S. Cl.
CPC *B41J 2/085* (2013.01); *B41J 2/09* (2013.01)

(58) Field of Classification Search
CPC ..... B41J 2/085; B41J 2/09; B41J 2002/1853; B41J 2/185; B41J 2/01; B41J 2/095
See application file for complete search history.

(56) References Cited

U.S. PATENT DOCUMENTS

2006/0139416 A1 6/2006 Nakazawa
2016/0082737 A1 3/2016 Washizawa et al.
2017/0182767 A1* 6/2017 Smith ..... B41J 2/02

FOREIGN PATENT DOCUMENTS

JP 08-187842 7/1996
JP 2001-270123 10/2001
(Continued)

OTHER PUBLICATIONS

International Search Report issued in International Patent Application No. PCT/JP2018/032307, dated Sep. 25, 2018, along with an English translation thereof.
(Continued)

*Primary Examiner* — Bradley W Thies
(74) *Attorney, Agent, or Firm* — Greenblum & Bernstein, P.L.C.

(57) ABSTRACT

In order to suppress adherence of ink splash to an electrode and ink contamination of surrounding environment, in a printing system, there is provided a continuous type ink jet printer having a nozzle for jetting ink in the form of particles, a charging electrode for electrically charging the jetted ink particles, and a deflection electrode for deflecting the charged ink particles. The system includes a printing section for printing an object to be printed with the ink particles jetted from the nozzle and a charging section configured to charge at least one of the printing object prior to its printing by the printing section and surrounding atmosphere in which the printing on the printing object is to be effected by the printing section with a polarity opposite to a polarity of the charge provided to the ink particles by the charging electrode.

9 Claims, 1 Drawing Sheet

(56) References Cited

FOREIGN PATENT DOCUMENTS

| | | |
|---|---|---|
| JP | 2006-175811 | 7/2006 |
| JP | 2013-082163 | 5/2013 |
| JP | 2016-064524 | 4/2016 |
| JP | 2016-115722 | 6/2016 |

OTHER PUBLICATIONS

Written Opinion issued in International Patent Application No. PCT/JP2018/032307, dated Sep. 25, 2018, along with a partial English translation thereof.

International Preliminary Report on Patentability issued in International Patent Application No. PCT/JP2018/032307, dated Mar. 12, 2020, along with an English translation thereof.

* cited by examiner

PRINTING SYSTEM, PRINTING DEVICE, AND METHOD OF PRODUCING PRINTED OBJECT

TECHNICAL FIELD

This invention relates to a system for producing a print, the system including a continuous type ink jet printer having a nozzle for jetting ink in the form of particles, a charging electrode for charging the jetted ink particles, and a deflection electrode for deflecting the charged ink particles and including also a printing section for printing an object to be printed with the jetted ink particles. The invention relates also to a printing device including the ink jet printer as well as a method of producing a printed object having a printing step of printing an object to be printed with the ink particles jetted from the nozzle by using the above-described ink jet printer.

BACKGROUND ART

An ink jet printer is in use for carrying out printing on an object to be printed. Such ink jet printer, as shown in FIG. 3, includes a continuous type (or continuous jetting type) ink jet printer 100 configured such that ink jetted in the form of particles from a nozzle 101 is electrically charged by a charging electrode 102 and then the resultant particulate ink 104 is deflected in a desired direction by a deflection electrode 103 to be adhered to a printing object 106, thus printing an intended desired pattern thereon (see e.g. Japanese Unexamined Patent Application Publication No. 2013-82163 (Patent Document 1), etc.).

PRIOR ART DOCUMENT

Patent Document

Patent Document 1: Japanese Unexamined Patent Application Publication No. 2013-82163

SUMMARY OF INVENTION

Problem to be Solved by Invention

When printing is carried out by an ink jet printer, not all of ink particles reaching the printing object will be adhered thereto as they should, but the remaining unadhered ink particles may be splashed back from the printing object to be scattered over in the surrounding, thus causing ink splash. Moreover, with the continuous ink jet printer 100 described above, the scattered ink splash 105 may reach the charging electrode 102 and/or the deflection electrode 103, thus being adhered thereto inadvertently. In that case, there may occur charging abnormality of the particulate ink 104 or a change in the shape of the electric field formed by the deflection electrode 103, so that a printing trouble may result therefrom.

Also, in recent years, there has been a trend for higher speed in the beverage production line and an increasing tendency is observed also in the production amount per unit time. Then, if the ink jet printer is applied to such beverage production line, with adherence of ink splash to the above electrodes, there will be increased concern about occurrence of printing error for containers being conveyed on the line. Further, such adherence of ink splash to the electrodes will necessitate temporary stop of the production line required for cleaning of the ink jet printer. Moreover, scattering and adhering of ink splash to the surrounding of the ink jet printer where sensors, an inspection camera, etc. are present, for possible system trouble or contamination of the surrounding, cleaning thereof will be required similarly. Therefore, in association with speeding-up of the production line, frequency of cleaning operations will increase also. Thus, there is an urgent need for effective suppression of adherence of ink splash to the electrodes for the sake of improvement in the production efficiency.

In view of the above, there is a need for realizing a printing system, a printing device as well as a method of producing a print, which can effectively suppress adherence of ink splash to the electrodes and the environment surrounding an ink jet printer.

Solution

A printing system, according to one aspect of the present invention, comprises:

a continuous type ink jet printer having a nozzle for jetting ink in the form of particles, a charging electrode for electrically charging the jetted ink particles, and a deflection electrode for deflecting the charged ink particles;

a printing section for printing an object to be printed with the ink particles jetted from the nozzle; and a charging section configured to charge at least one of the printing object prior to its printing by the printing section and surrounding atmosphere in which the printing on the printing object is to be effected by the printing section with a polarity opposite to a polarity of the charge provided to the ink particles by the charging electrode.

Namely, the present inventor has found out that the significant factor that inadvertently allows scattered ink splash to reach the charging electrode and/or the deflection electrode is that ink splash generated from the electrically charged ink particles is charged similarly, thus being attracted to these electrodes. (in the ink jet printer 100 shown in FIG. 3, ink splash 105 produced by negatively charged ink particles 104 is charged negatively also, whereby the ink splash is attracted to the deflection electrode 103 charged positively). Based on this finding, the present inventor has made further finding that adherence of ink particles to the electrodes can be effectively suppressed by charging at least one of the printing object prior to its printing by the printing section and surrounding atmosphere in which the printing on the printing object is to be effected by the printing section with a polarity opposite to the polarity of a charge provided to the ink particles by the charging electrode.

Namely, if the printing object is charged with the opposite polarity to that of the charge to be provided to the ink particles, the ink particles can be attracted to the printing object and the generation amount of ink splash can be reduced. Moreover, as the ink particles collide the oppositely charged printing object, the charge of the charged ink particles can be electrically neutralized or the amount thereof can be reduced. With this, even if ink splash occurs, such ink splash can be electrically neutralized or its charge amount can be reduced. In this manner, by charging the printing object with charge of the opposite polarity to that of the charge provided to the particulate ink, it is possible to reduce the amount of ink splash generated. Further, since the resultant ink splash will be electrically neutralized or have its charge amount reduced, the attraction of the ink splash to the electrodes can be effectively suppressed.

Similarly, if the surrounding atmosphere in which printing is to be carried out is charged with the opposite polarity to that of the charge provided to the particulate ink, the resultant ink splash can be electrically neutralized or have its charge amount reduced, so the attraction of the ink splash to the electrodes can be effectively suppressed. Moreover, with neutralization of the charge of the ink splash per se, undesired adherence of the splash to the surrounding environment of the ink jet printer such as sensors, an inspection camera, etc., can be effectively suppressed. Thus, contamination of the surrounding environment can be effectively suppressed also.

In this way, with the above-described inventive arrangement, adherence of ink splash to the electrodes in an ink jet printer can be effectively suppressed.

Next, some preferred embodiments of the printing system relating to the present invention will be explained. It is noted however that the preferred embodiments to be described next are not to limit the claimed scope of the present invention in any way.

According to one embodiment, the printing system further comprises a conveyance line for conveying the printing object; and the printing section and the charging section are disposed along the conveyance line, with the charging section being positioned on more upstream side in the conveying direction than the printing section.

With the above-described arrangement of the printing section and the charging section along the conveyance line, adherence of ink splash to the electrodes can be effectively suppressed while printing operation(s) is (are) effected on the printing object(s) which is (are) being conveyed continuously.

According to one embodiment, the charging section is configured to be able to charge at least the atmosphere surrounding the printing object.

With the above-described arrangement, in association with conveyance of the printing object, charged atmosphere surrounding the printing object will also be attracted toward the printing section. So, the surrounding atmosphere where printing operation on the printing object is to be effected in the printing section can also be charged with the opposite polarity to that of the charge provided to the particulate ink.

According to one embodiment, the printing system further comprises an air feeding section for feeding air that flows from the charging section toward the printing section.

With the above-described arrangement, it is possible to promote the attraction of the atmosphere surrounding the printing object which has been charged in the charging section to the printing section.

According to one embodiment, the charging section is configured to be able to charge at least the surrounding atmosphere; and the surrounding atmosphere is partitioned by an enclosure.

With the above-described arrangement, it is possible to effectively suppress scattering of the charged surrounding atmosphere and to effectively promote the electrical neutralization or the reduction of the charge of ink splash generated.

According to one embodiment, the inside of the ink jet printer is provided with a positive pressure relative to its outside.

The above-described arrangement can effectively suppress intrusion of ink splash to the inside of the ink jet printer.

According one embodiment, the printing system comprises a plurality of the charging sections; and at least one charging section thereof is configured to eliminate charge originally present in the printing object.

This arrangement can provide efficient charging of the printing object.

A printing device according to a further aspect of the present invention comprises:

a continuous type ink jet printer having a nozzle for jetting ink in the form of particles, a charging electrode for charging the jetted ink particles, and a deflection electrode for deflecting the charged ink particles; and a charging section configured to charge at least one of the printing object prior to its printing by the ink jet printer and surrounding atmosphere in which the printing on the printing object is to be effected by the ink jet printer jetted with a polarity opposite to the polarity of the charge provided to the ink particles by the charging electrode.

A method for producing a printed object according to a still further aspect of the present invention, including a printing step in which a continuous type ink jet printer having a nozzle for jetting ink in the form of particles, a charging electrode for charging the jetted ink particles, and a deflection electrode for deflecting the charged ink particles is used for printing an object to be printed with the ink particles jetted from the nozzle, the method comprises:

a charging step effected prior to the printing step, for charging at least one of the printing object and surrounding atmosphere in which the printing step is to be effected on the printing object in the printing step with a polarity opposite to the polarity of the charge provided to the ink particles by the charging electrode.

With the above-described inventive configurations, similar advantageous functions and effects to those provided by the above-described system for manufacturing printed object can be obtained.

EMBODIMENTS OF INVENTION

Next, embodiments of a printing system, a printing device and a printing method of a printed object all relating to the present invention will be explained with reference to the accompanying drawings. In the following discussion, there will be explained an example in which a printing system 1 relating to this embodiment of the invention is incorporated within a manufacturing line for manufacturing PET bottled products charged with beverage and printing operations (character (sign) printing operations) are carried out by the printing system 1 on caps 7 of the PET bottled products, with the caps 7 being "printing objects" (or objects to be printed).

Figure 1:
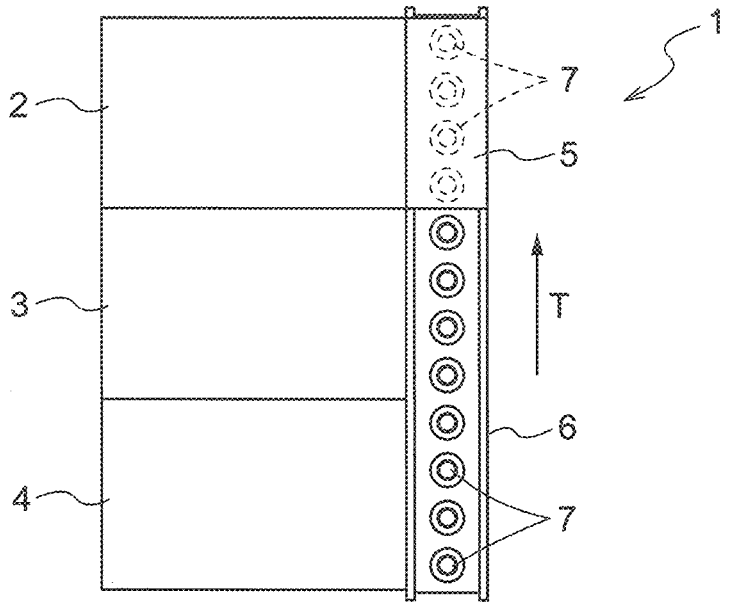
FIG. 1 is a schematic view of a printing system.

FIG. 1 shows such printing system 1 incorporated in a part of the PET bottled products manufacturing line. The printing system 1 includes a conveyance line 6 for conveying the PET bottled products with the caps 7 thereon. Along this conveyance line 6, there are disposed a printing section 2 for printing the caps 7, a charging section 3 for electrically charging the caps 7 and a water droplets removing section 4 for removing water droplets from the caps 7 of the PET bottled products.

Figure 2:
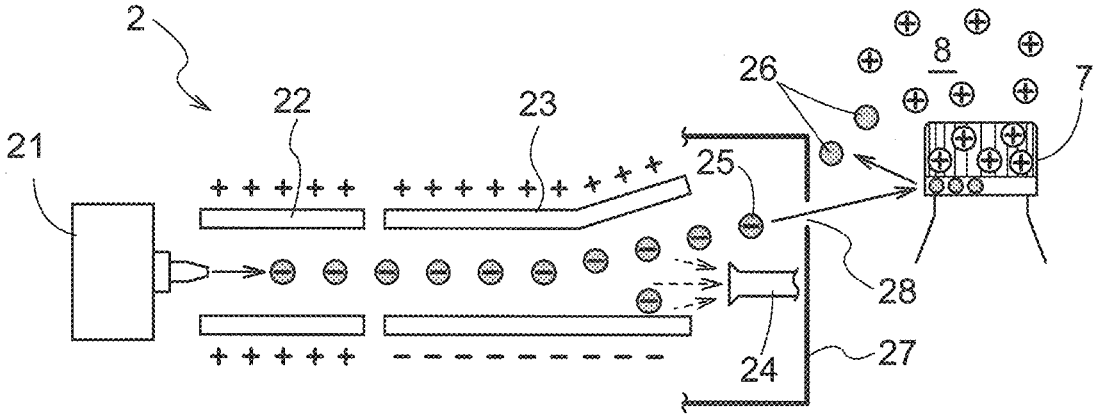
FIG. 2 is a view illustrating a printing operation using an ink jet printer.
Figure 3:
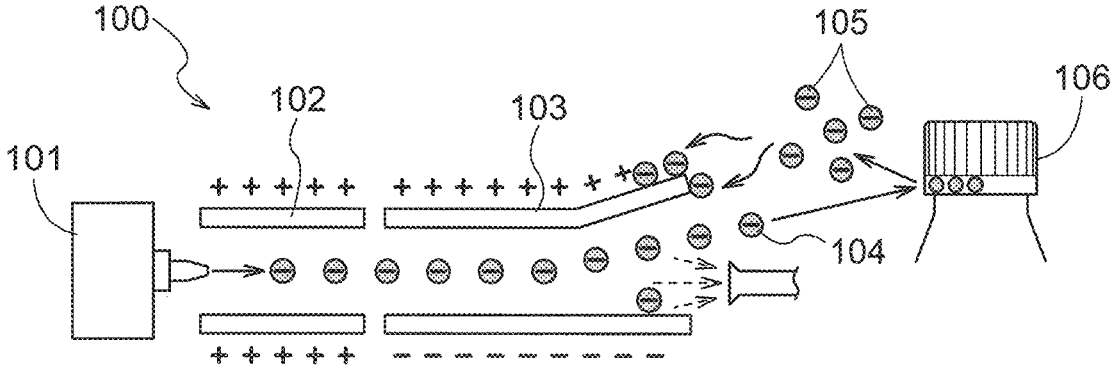
FIG. 3 is a view illustrating a printing operation using a conventional ink jet printer.

The printing section 2, as shown in FIG. 2, includes a continuous ink jet printer having a nozzle 21 for discharging ink in the form of particles (i.e. particulate ink), a charging electrode 22 for negatively charging the discharged ink particles 25, a deflection electrode 23 for deflecting the charged ink particles 25 and a gutter 24 for collecting the ink particles 25 which have failed to be deflected by the deflection electrode 23. In this printing section 2 in operation, after the particulate ink (ink particles) 25 is electrically charged by the charging electrode 22, the charged particulate ink 25 is deflected to a desired direction by the deflection electrode 23 to be attracted to the caps 7, whereby intended pattern printing operations thereof are carried out. Further, on the forward side in the ink advancing direction of the deflection electrode 23, there is provided a cover 27 having a discharge outlet 28 through which the particulate ink 25 to be adhered to the caps 7 is caused to pass, thus protecting the ink jet printer from ink splash 26 from the caps 7. The inside of this ink jet printer (more particularly, the inside of the discharge outlet 28) is provided with a positive pressure relative to the outside thereof, thus effectively suppressing intrusion of the ink splash 26 to the inside of the ink jet printer through the discharge outlet 28. Also, in the printing section 2, surrounding atmosphere 8 in which the printing operations are to be effected on the caps 7 is partitioned with an enclosure 5.

The charging section 3 is disposed on more upstream side in a conveyance direction T than the printing section 2. In the instant embodiment, the charging section 3 is disposed adjacent the printing section 2 so that the charging operations of the caps 7 may take place immediately before the printing operations on the caps 7 by the printing section 2. The charging section 3 is equipped with e.g. an ionizer so that the particulate ink 25 may be electrically charged by this charging section 3 with the opposite polarity to the polarity (negative polarity) of the electric charge provided to the particulate ink 25 by the charging electrode 22. Further, the charging section 3 is configured also to be able to charge the atmosphere surrounding the caps 7 in association with the charging of these caps 7. With this, in association with conveyance of the caps 7, the electrically charged surrounding atmosphere too will be attracted toward the printing section 2. Thus, the surrounding atmosphere 8 in which printing operations on the caps 7 are to be effected can also be electrically charged with the opposite (i.e. positive in this case) polarity to the polarity of the charge provided to the particulate ink 25.

The water droplets removing section 4 is provided for removing water droplets so as to prevent water droplets remaining if any on the caps 7 from interfering with the electrical charging operations and the printing operations to be effected subsequent thereto and this water droplets removing section 4 may employ any known device. Incidentally, although the printing section 2, the charging section 3 and the water droplets removing section 4 are disposed respectively adjacent each other in FIG. 1, the water droplets removing section 4 may alternatively be disposed distantly from the charging section 3. Further, the printing section 2 and the charging section 3 can also be disposed distant from each other along as the advantageous function/effect of the present invention can be achieved.

Furthermore, along the conveyance line 6, the above-described sections are disposed from the upstream side in the conveyance direction T, in the order of: the water droplets removing section 4, the charging section 3 and the printing section 2, so that water droplets removing step, charging step, and printing step are carried one after another in this order. In this way, as the electrical charging step is effected prior to the printing step, in the printing system 1, adherence of ink splash 26 to the electrodes 22, 23 can be effectively suppressed.

Namely, according to the printing system 1, since the caps 7 are charged with the opposite polarity to the polarity of the charge provided to the particulate ink 25, the particulate ink 25 is attracted to the caps 7, thus a generation amount of the ink splash 26 is reduced (see FIG. 2). Moreover, since the particulate ink 25 collides the caps 7 charged with the opposite polarity, the charged particulate ink 25 is electrically neutralized or the amount of their charge is reduced. With this, even in the event of generation of ink splash 26, this ink splash 26 will be either electrically neutralized or the amount of charge thereof will be reduced. Further, according to this printing system 1, the surrounding atmosphere 8 too is electrically charged with the opposite polarity to the polarity of the electrical charge provided to the particulate ink 25, so that the ink splash 26 generated can be electrically neutralized or the amount of its charge can be reduced. Consequently, it is possible to suppress attraction of the ink splash 26 to the electrodes 22, 23. In this way, with this printing system 1, the generation amount of the ink splash 26 can be reduced and the ink splash 26 if generated may be electrically neutralized or the amount of its charge can be reduced. Thus, attraction of the ink splash 26 to the electrodes 22, 23 can be effectively suppressed. Moreover, as the electrical charge of the ink splash per se is neutralized, adherence thereof to the surrounding environment of the ink jet printer such as sensors, an inspection camera, etc. can be suppressed, so that contamination of the surrounding atmosphere can be effectively suppressed also.

In addition, in the printing section 2, as the surrounding atmosphere 8 is partitioned by the enclosure 5, scattering of the charged surrounding atmosphere 8 is suppressed, so that the electrical neutralization and the reduction of the charge amount of the ink splash 26 generated are promoted.

Lastly, as an example of the advantageous effects of the printing system 1 relating to this embodiment, there will be explained a result of comparison made between contamination of the electrodes between a case in which the printing system according to the embodiment was operated and a case in which a printing system according to a comparison example was operated.

System Arrangement

As an example, there was employed the printing system 1 in which a water droplet removing device (manufactured by DI Engineering Corporation) as the water droplets removing section 4, an ionizer (manufactured by KEYENCE Co. Ltd.) as the charging section 3, and an ink jet printer (manufactured by Hitachi High-Tech Solutions Corporation) as the printing section 2 were arranged in this mentioned order on a conveyance line 6 of PET bottled products charged with beverage to allow passage therethrough of these PET bottled products. As a comparison example, there was employed a printing system without the charging section 3, namely a printing system similar to that of the example, except in that the printing step is effected directly after the water droplet removing step, without the charging step therebetween.

Charge Amount Determinations of Caps and Surrounding Atmosphere

In order to determine change in the charge amount of the caps, in the printing system of the example, with using a static electricity determination device (manufactured by KEYENCE Co. Ltd.), electric charge amount determinations were carried out on the caps at three positions: namely, a position before the charging process, a position after the charging process, and a position after the printing process, while the PET bottles products were caused to flow on the conveyance line. Further, in order to determine change in the change amount of the surrounding atmosphere, in the printing system of the example and in the printing system of the comparison example, respectively, with using the same static electricity determination device, the charge amounts of the surrounding atmosphere of the caps 7 were determined while the PET bottles products were caused to flow on the conveyance line.

Results of Electric Charge Amount Determinations of Caps

In the electric charge amount determinations of caps using the printing system of the example, the electric charge amounts determined at the respective positions were: −219 V before passage through the charging step, +1.8 kV after passage through the charging step and +807 V after passage through the printing step. Thus, according to the printing system of the example, as the caps underwent the charging step, the charge state changed from negative to positive and also after the passage through the printing step, the positively charged state was maintained, and its charge amount was still sufficient.

Results of Charge Amount Determinations of Surrounding Atmosphere

In the electric charge amount determinations of the surrounding atmosphere of the caps, with the printing system of the comparison example, the electric charge amount of the cap in the water droplet removing step was −219V, and the electric charge amount of the surrounding atmosphere was −800V (in this example, the surrounding atmosphere of the ink jet printer). Whereas, with the printing system of the example, the electric charge amount of the cap in the water droplet removing step (i.e. the surrounding atmosphere of the cap prior to its passage through the charging section) was −219V, whereas the charge amount of the surrounding atmosphere (in this example, the atmosphere surrounding the ink jet printer, i.e. the atmosphere after passage through the charging step) was +2.0 kV. In this way, it may be understood that in the printing system of the example, not only the cap but also the surrounding atmosphere was electrically charged by the charging section.

Checking of Contamination of Electrodes and Surrounding Atmosphere

In the printing systems of the example and the comparison example, respectively, cap printing operations were effected with using yellow-colored pigment ink on PET bottled products conveyed by a conveyance line. In each case, the states of the electrodes and the surrounding atmosphere of the ink jet printer upon completion of printing operations of 20 thousands bottles were checked. Firstly, in the printing system of the comparison example, adherence of ink was observed already on the electrodes and the surrounding of the ink jet printer at the time after printing of 20,000 bottles. In contrast, in the printing system of the example, no adherence of contaminant was observed on the electrodes or the surrounding of the ink jet printer at the time after printing of 20,000 bottles. Thereafter, the printing system of the example was continuously operated after the printing of 20,000 bottles to continue cap printing of further PET bottled products. It was found that even at time after printing of 3 million (3,000,000) bottles, no contamination was observed on the electrodes or the surrounding of the ink jet printer. From the above-described results, it may be understood that with the execution of the charging step of electrically charging the caps or the surrounding atmosphere as provided in the printing system of the example, contamination of the electrodes and the surrounding atmosphere of the ink jet printer can be suppressed effectively.

Other Embodiments

Lastly, other embodiments of the printing system, the printing device and the manufacturing method of printed object all relating to the present invention will be explained. Incidentally, arrangements disclosed in the respective embodiments as follow can be used in any desired combination with the arrangements disclosed in the other embodiments, as long as no contradiction results from such combining.

(1) The printing system 1 of the foregoing embodiment may further include an air feeding section for feeding air from the charging section 3 toward the printing section 2. With this, it becomes possible to promote the attraction of the surrounding atmosphere of the cap 7 electrically charged by the charging section 3 to the printing section 2.

(2) In the foregoing embodiment, there was explained a configuration using caps 7 as the "printing objects". However, the present invention is not limited thereto. The printing object can be also various kinds such as a bottle, a label, a plastic product such as a shrink wrapping, a cup, etc., or a (glass) bottle and a (glass) bottle label, a can, a paper-made carton container, a cardboard, etc.

(3) In the foregoing embodiment, there was explained as an example, the arrangement in which both the cap 7 as the printing object and the surrounding atmosphere 8 are positively charged. However, the present invention is not limited thereto. Only either one of the printing object and the surrounding atmosphere may be charged. Further, the sole requirement of the electrical charge to be provided to the printing object and/or the surrounding atmosphere is it having the opposite polarity to that of the electrical charge provided to the particulate ink. Thus, if the particulate ink is positively charged, the printing object and/or the surrounding atmosphere will be negatively charged. In addition to the above, the arrangement of electrically charging the printing object and/or the surrounding atmosphere is not limited to the above, but can be modified appropriately, depending on the object.

(4) In the foregoing embodiment, there was explained as an example the arrangement in which the charging section 3 is disposed on more upstream side than the printing section 2 in the conveyance direction T along the conveyance line 6. However, the present invention is not limited thereto. The printing section 2 and the charging section 3 need not be disposed along the conveyance line 6. Further, the arrangement of the charging section 3 can be modified appropriately in a range that allows charging of either one of the printing object and the surrounding atmosphere, such as a modified arrangement of disposing the charging section 3 within the printing section 2 for charging the surrounding atmosphere.

(5) In the forgoing embodiment, there was explained, as an example, the arrangement in which one charging section 3 is provided. However, the invention is not limited thereto. For instance, with provision of a plurality of charging sections 3, these may be set respectively with charge amounts different from each other. With this, even more effective charging of the printing object becomes possible. Further, if such plurality of charging sections 3 are provided, at least one charging section 3 thereof may be configured as a charge removing section. In this case, for instance, by causing one or more charging sections 3 disposed on the upstream side in the conveyance direction to function as such charge removing section(s), before the printing object is electrically charged by the charging section 3 with the opposite polarity to the polarity of the electrical charge of the ink, the electrical charge present in the printing object can be removed by the charge removing section (charging section 3).

(6) In the foregoing embodiment, there were explained as examples, the arrangement of the surrounding atmosphere 8 being partitioned by the enclosure 5 and the arrangement of the inside of the ink jet printer being provided with a positive pressure relative to the outside thereof. However, the invention is not limited thereto. The surrounding atmosphere 8 need not necessarily be partitioned by the enclosure 5. Moreover, the inside of the ink jet printer need not necessarily be provided with a positive pressure relative to the outside thereof.

(7) In the foregoing embodiment, no particular reference was made to the kind of the ink to be used. In fact, the kind or type of the ink to be employed in the present invention is not particularly limited. Needless to say, any conventional ink such as a pigment ink, a dye ink, etc. can be employed, and the present invention is applicable to ink of any known kind of color.

(8) In the foregoing embodiment, there was explained the configuration in which the charging step is carried out by the printing system 1 prior to the printing step. However, the present invention is not limited thereto. The charging step may be effected prior to the printing step, with using a printing device having a continuous type ink jet printer having a nozzle for jetting ink in the form of particles, a charging electrode for charging the jetted ink particles, and a deflection electrode for deflecting the charged ink particles and an electrical charging device configured to electrically charge at least one of the printing object prior to its printing by the ink jet printer and surrounding atmosphere in which the printing on the printing object is to be effected by the ink jet printer with a polarity opposite to the polarity of the charge provided to the ink particles by the charging electrode.

(9) It should be understood that in the respect of the other arrangements too, the embodiments disclosed in this detailed description are only exemplary in all respects thereof and the scope of the present invention is not limited thereto. It can be readily understood by those skilled in the art that various modifications can be made appropriately in a range not deviating from the essence of the present invention. Therefore, such other embodiments with modifications within such range not deviating from the essence of the present invention are included also within the scope of the present invention.

INDUSTRIAL APPLICABILITY

The present invention is applicable to e.g. printing of a printing object.

DESCRIPTION OF SIGNS

1 printing system
2: printing section
21: nozzle
22: charging electrode
23: deflection electrode
25: particulate ink (ink particles)
26: ink splash
3: charging section
5: enclosure
6: conveyance line
7: printing object (object to be printed)
8: surrounding atmosphere

The invention claimed is:

1. A printing system comprising:

a continuous type ink jet printer having a nozzle for jetting ink in the form of particles, a charging electrode for electrically charging the jetted ink particles, and a deflection electrode for deflecting the charged ink particles;

a printing section for printing an object to be printed with the ink particles jetted from the nozzle; and a charging section configured to charge at least one of the printing object prior to its printing by the printing section and surrounding atmosphere in which the printing on the printing object is to be effected by the printing section with a polarity opposite to a polarity of the charge provided to the ink particles by the charging electrode.

2. The printing system of claim 1, wherein:

the printing system further comprises a conveyance line for conveying the printing object; and the printing section and the charging section are disposed along the conveyance line, with the charging section being positioned on more upstream side in the conveying direction than the printing section.

3. The printing system of claim 2, wherein the charging section is configured to be able to charge at least the atmosphere surrounding the printing object.

4. The printing system of claim 3, further comprising an air feeding section for feeding air that flows from the charging section toward the printing section.

5. The printing system of claim 1, wherein:

the charging section is configured to be able to charge at least the surrounding atmosphere; and the surrounding atmosphere is partitioned by an enclosure.

6. The printing system of claim 1, wherein the inside of the ink jet printer is provided with a positive pressure relative to its outside.

7. The printing system of claim 1, wherein:

the printing system comprises a plurality of the charging sections; and at least one charging section thereof is configured to eliminate charge originally present in the printing object.

8. A printing device comprising:

a continuous type ink jet printer having a nozzle for jetting ink in the form of particles, a charging electrode for charging the jetted ink particles, and a deflection electrode for deflecting the charged ink particles; and a charging section configured to charge at least one of the printing object prior to its printing by the ink jet printer and surrounding atmosphere in which the printing on the printing object is to be effected by the ink jet printer jetted with a polarity opposite to the polarity of the charge provided to the ink particles by the charging electrode.

9. A method for producing a printed object including a printing in which a continuous type ink jet printer having a nozzle for jetting ink in the form of particles, a charging electrode for charging the jetted ink particles, and a deflection electrode for deflecting the charged ink particles is used for printing an object to be printed with the ink particles jetted from the nozzle, the method comprising:

a charging effected prior to the printing, for charging at least one of the printing object and surrounding atmosphere in which the printing is to be effected on the printing object during the printing with a polarity opposite to the polarity of the charge provided to the ink particles by the charging electrode.

* * * * *